United States Patent [19]

Smith

[11] 4,141,391

[45] Feb. 27, 1979

[54] WATER LIFTING SYSTEM

[76] Inventor: Lester W. Smith, 10525 Compton Blvd. #10, Bellflower, Calif. 90706

[21] Appl. No.: 869,251

[22] Filed: Jan. 13, 1978

[51] Int. Cl.[2] ..... B65B 31/00

[52] U.S. Cl. ..... 141/59; 141/113

[58] Field of Search ..... 137/205, 627.5; 141/1, 141/2, 7, 18, 59, 60, 61, 65, 113, 302, 305, 324, 198; 222/64, 65; 239/468

[56] References Cited

U.S. PATENT DOCUMENTS

| | | | |
|---|---|---|---|
| 1,745,179 | 1/1930 | Milne | 137/205 |
| 3,532,271 | 10/1970 | Polnauer | 239/468 X |

*Primary Examiner*—Richard E. Aegerter
*Assistant Examiner*—Frederick R. Schmidt
*Attorney, Agent, or Firm*—Dominick Nardelli

[57] ABSTRACT

This system is economic and trouble free and has a cylindrical wall chamber formed on the top of an inverted water bottle that is elevated above the floor. A chamber communicates with the water bottle through a hole formed therein. Near the lower end of the cylindrical wall an opening is formed to allow a short tube to extend through the wall substantially tangent thereto. Above the tube and fixed to the interior of the wall is an apertured disc. Between the apertured disc and the bottom of the chamber is disposed a spiral wall with one end fixed to the cylindrical wall so that a spiral passageway is formed, communicating with the tube. Within the chamber is placed a piston which is free to slide axially up and down. Hanging from the underside of the piston is a rod which holds a valve gate disposed to seal the opening between the bottle and chamber. The rod also supports, on its lower end, a stopper or plug which is disposed to seal the neck of the bottle. The top of the chamber is connected to a vacuum source and the short tube has a flexible hose which extends down into a full 5-gallon water bottle. When the vacuum is drawn, the piston is lifted nearer the top of the chamber, lifting together the valve gate and stopper. The stopper now plugs the neck opening of the inverted water bottle. Air in the bottle is sucked out from around the piston and the chamber wall, to cause water to be lifted up the tube and into the inverted bottle.

3 Claims, 3 Drawing Figures

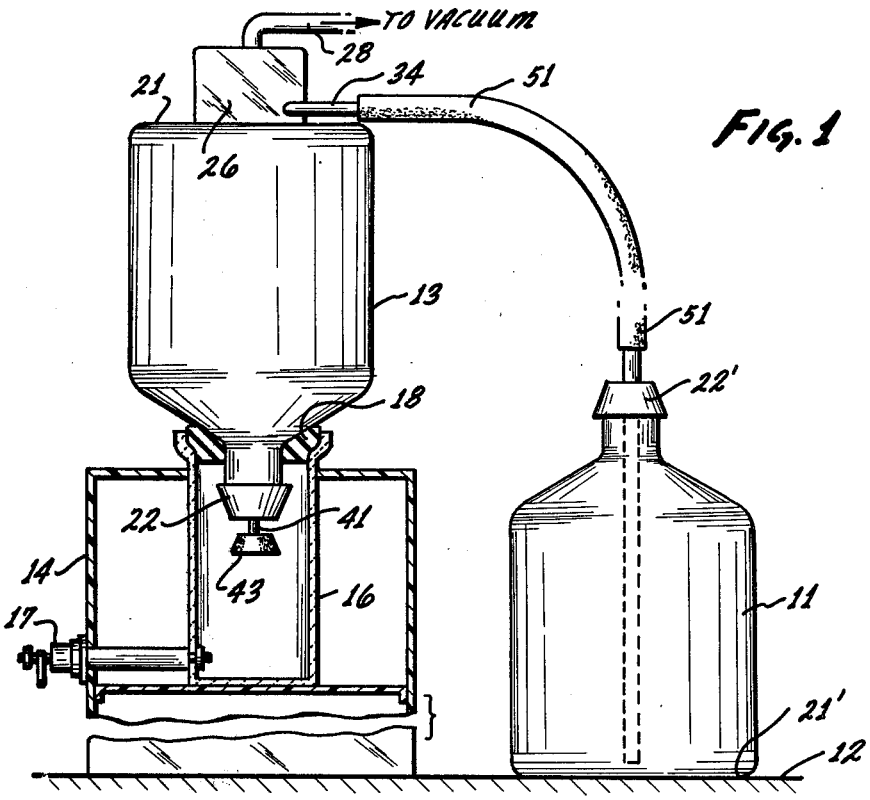
FIG. 1
FIG. 2
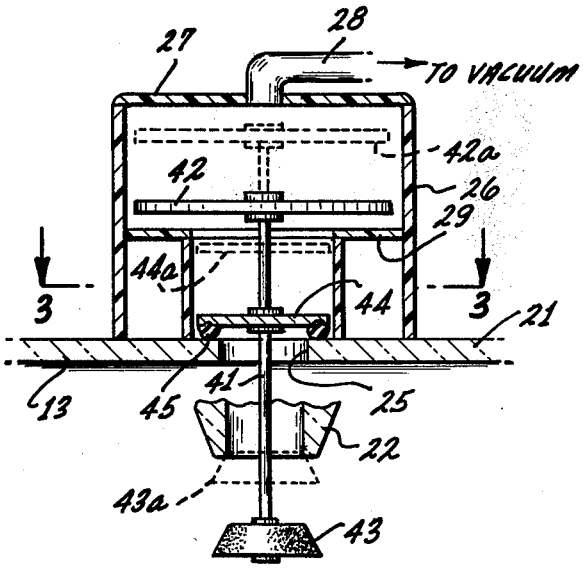
FIG. 3
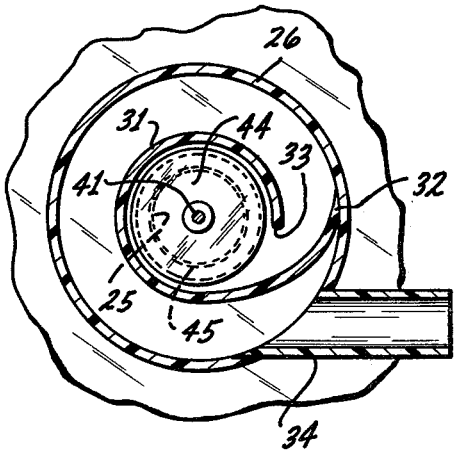

WATER LIFTING SYSTEM

FIELD OF THE INVENTION

This invention is related to a drinking water system and, more particularly, to a system for lifting water from a reservoir on the floor to a dispensing gravity-fed bottle elevated above the floor.

BACKGROUND OF THE INVENTION

Most tap water is considered unsatisfactory for drinking, by many people, for reasons of taste and/or health. For example, many people buy fluoride water for their growing children. People with cardiovascular disorders should drink water that is low in sodium. Other people just don't like the taste of tap water, while still others find it more convenient to use bottled water than to run a water line to the place of use. Such water is available commercially in, for example, 5-gallon glass bottles delivered to the user's location.

The conventional dispenser comprises an open top reservoir having a gravitational flow bottom output terminated by a tap. The open top of the reservoir receives the shoulder of an inverted supply bottle so that the mouth or neck of the supply bottle extends down into the reservoir. The water flows out of the bottle, filling the reservoir, until the opening of the bottle is below the water surface. Only when water is drained from the tap, lowering the water surface, will water again flow out of the bottle. When the supply bottle is empty, it can be readily removed as it is light because it is empty. The full bottle must be now lifted and inverted over the reservoir. When one considers that a 5-gallon filled water bottle weighs more than 50 pounds, the person lifting it must be relatively strong and healthy. Since people who had heart attacks especially need low sodium water, they find it impossible to lift the filled water bottle because of their weakened condition.

The bottled water industry has long recognized a need for a solution to the foregoing problem and, in the past, means have been devised for lifting water from the floor to the dispenser. Some of these means are taught in U.S. Pat. Nos. 3,653,413; 3,495,612; and others. These prior art means are either expensive and need new equipment, as disclosed in U.S. Pat. No. 3,495,612; or required a self-contained motor assembly, as taught in U.S. Pat. No. 3,653,413. This latter patent also requires the user to make sure that the mouth of the inverted bottle is plugged before one attempts to refill the bottle.

OBJECTS OF THE INVENTION

An object of this invention is to provide a system that is simple and economical for lifting water from a bottle on the floor to a raised bottle in a dispenser.

Another object of this invention is to provide a system for lifting water with a suction means.

Another object of this invention is to provide a system for lifting water that operates in response to a vacuum such as is provided by a household vacuum cleaner.

These and other objects and features of advantage will become more apparent after one studies the following detailed description of the preferred embodiment of my invention, together with the appended drawing.

BRIEF DESCRIPTION OF THE DRAWING

FIG. 1 shows one embodiment of my novel system, showing a modified water bottle in operative association with the water cooler and dispenser, coupled to a source bottle on the floor.

FIG. 2 is an enlarged axial section, in elevation, of the top portion of my modified water bottle.

FIG. 3 is a sectional view, taken on line 3—3 of FIG. 2 in the direction of the arrows.

DETAILED DESCRIPTION OF THE DRAWING

Referring to FIG. 1, my novel system is shown ready to transfer water from a standard water bottle 11, resting on a floor 12, to my modified water bottle 13 mounted on top of a standard dispenser 14. The dispenser 14 is a typical standard dispenser, having the ceramic reservoir 16 with an open top and a suitable outlet valve 17 coupled to the lower portion of the reservoir 16. Around the top of the reservoir is placed a resilient ring 18 to form a buffer between the reservoir 16 and my modified bottle 13. This dispenser 12 is very similar to the dispenser described in the above mentioned U.S. Pat. No. 3,653,413.

Referring to FIG. 2, I will now describe my modified water bottle. Basically, bottle 13 is similar to bottle 11, but with the following modifications: On the substantially flat bottom 21, which is now inverted and shown disposed above the neck 22, a hole 25 is formed by suitable means in bottom 21, and, preferably, axially disposed over the neck 22. Over the hole 25 a chamber is formed which has a tubular wall 26 preferably made cylindrical. The wall 26 could be made of plastic or glass and sealed to the bottom 21 by suitable means. The wall 26 is topped with a cover 27 sealed to the wall 26 and an opening is provided in the cover to which is coupled a tube 28 which is capable of being coupled to a suitable vacuum supply, for example, a standard household vacuum cleaner. Between the bottom 21 and the cover 27 is fixedly disposed an annular member 29, which is bonded and sealed to the wall 26. The opening in member 29 is preferably larger than the opening 25 in the bottle bottom 21, for reasons that will become more apparent hereinafter. As shown in FIG. 3, between the member 29 and bottom 21 is disposed a vortex forming means which includes a spiral wall 31, having one end 32 sealed to the wall 26 and the other end 33 spaced therefrom, as shown. Tangentially disposed to and extending through the wall 26 near the end 32 is a tubulation 34. If one traces a path from the outside of the tubulation 34 to the hole 25, one finds the path is a spiral. Freely suspended with the bottle 13 and the chamber 11 is a rigid rod 41 having fixed at its upper end a piston or disc 42, made slightly smaller than the inside diameter of the wall so that the disc 42 is free to move axially therein. On the lower end of rod 41 is mounted a plug 43 which, when lifted by the rod, is capable of sealing the mouth or opening in neck 22. Below the disc 42 and around the rod is mounted a valve gate 44 which is shown in sealing engagement with an annular seal 45 disposed around the hole 25. The weight of the rod 41, disc 42, plug 43 and seal 45 cause to form an effective air-tight seal around the hole 25 so that, in normal operation, air can only enter the bottle 13 through the opening in neck 22, thereby preventing overflow and flooding of the reservoir 16.

DESCRIPTION OF THE FILLING OPERATION

When bottle 13 is empty, one need only couple one end of a hose 51 to the tubulation 34 and place the other end in the neck 22' of the full water bottle 11, as shown in FIG. 1. Bottle 11 is sitting on the floor by its bottom 21'. Bottle need not be placed close to the dispenser if one has a sufficiently long hose 51 to reach the bottle 11. After the hose is placed in the neck 22' then one takes one end of the vacuum hose (not shown) leading from a standard household vacuum cleaner, for example, the cannister type, and couples the vacuum hose to the tube 28. The vacuum cleaner and hose are not shown, for obvious reasons. When the vacuum is drawn, the piston 42 is lifted to the position shown by dash lines 42*a*, thereby lifting lower plug 43 to the position shown by dash lines 43*a* to seal the mouth of bottle 13. The valve gate 44 is also lifted to the position shown by dash lines 44*a*, which position is preferably near the annular member 29, for reasons that will become apparent hereinafter. The air in bottle 13 is sucked up through hole 25 around past the raised valve gate 44 and around past the raised piston 42, forming a partial vacuum therein. This causes water to be sucked up through hose 51 and enter chamber 26. In so entering, the water forms a vortex due to the spiral path formed by spiral wall 31. The vortex prevents the water from completely covering the hole 25 so that as the water enters bottle 13, the air therein is displaced up through the axial center of the hole 25. Since the raised valve gate is near the member 29 or above member 29, the entering water is prevented from being sucked up over the valve gate. Since preferably five gallons of water is lifted from a 5-gallon supply bottle to our modified 5-gallon bottle, one need not monitor the operation closely. The water, when it is completely transferred, remains in my modified water bottle 13 as long as the vacuum is drawn. Then when the vacuum is cut off, the piston 42 falls to cause the valve gate 44 to seal up the hole 25. Water may now be dispensed.

Having described the preferred embodiment of my invention, one skilled in the art, after studying the above disclosures, can devise other embodiments without departing from the spirit or scope of my invention. Therefore, my invention is not to be considered as limited to the disclosed embodiment, but includes all embodiments falling within the scope of the appended claims.

I claim:

1. A water lifting system in combination with a source bottle and an inverted supply bottle which is elevated above the source bottle; said system comprising:

said supply bottle having a neck and opening and a substantially flat bottom disposed above the neck thereof;

said supply bottle having a hole formed in said bottom;

a chamber with a tubular wall disposed on top of and communicating by means of said hole in said bottom with said supply bottle;

a tubulation attached to said tubular wall, extending from said chamber and communicating with the interior thereof;

a spiral wall disposed within said chamber so that any fluid entering said chamber through said tubulation is forced to form a vortex;

means for coupling said tubulation to said source bottle;

means for lifting the water from said source bottle into said chamber so that said liquid forms a vortex within said chamber as the liquid falls through said hole;

an annular member disposed within said chamber and disposed perpendicularly to the axis thereof;

said spiral wall being disposed between said member and the bottom of said chamber;

a piston slidably disposed within said chamber and above said member;

a rod depending from said piston through said hole and through said neck;

a plug fixed to the lower end of said rod and capable of sealing said neck of said supply bottle whenever said pison is lifted; and a valve gate fixed to said rod and disposed between said hole and said piston so that when gravity causes the piston to fall, said gate seals said hole.

2. The system of claim 1 wherein said means for lifting the liquid comprises:

a cover having an opening disposed over said chamber; and means for coupling said opening in said cover to a vacuum supply.

3. A system for lifting fluid from a source bucket, said system comprising:

a bottle adapted to contain water and having an opening at its lower and a hole at its upper end and said opening and hole being aligned vertically;

a tubular wall disposed on top of said bottle and around said hole;

a tubulation extending from said tubular wall and adapted to be coupled to said source bucket;

means disposed within said tubular wall for forcing any fluid entering therein through said tubulation into a vortex;

an annular cover disposed on top of said tubular wall and adapted to be coupled to a vacuum so that fluid could be drawn through said tubulation;

a piston slidably disposed within said wall and between said means and said annular cover, said piston responds to said vacuum;

a rod depending from said piston and extending through said hole and said opening;

a plug fixed to the lower end of said rod and disposed outside said bottle;

a valve gate fixed to said rod and disposed between said hole and said piston and being axially spaced from said plug so that when said valve gate rests against and thereby sealing said hole said plug is spaced from said opening and when said piston is lifted in response to the vacuum said plug seals said opening while said gate is spaced from said hole.

* * * * *